US005511529A

United States Patent [19]

Blumenstock et al.

[11] Patent Number: 5,511,529

[45] Date of Patent: Apr. 30, 1996

[54] TANK-VENTING APPARATUS FOR A MOTOR VEHICLE AND METHOD FOR OPERATING THE APPARATUS

[75] Inventors: Andreas Blumenstock, Ludwigsburg; Helmut Denz, Stuttgart, both of Germany

[73] Assignee: Robert Bosch GmbH, Stuttgart, Germany

[21] Appl. No.: 230,485

[22] Filed: Apr. 20, 1994

[30] Foreign Application Priority Data

Apr. 20, 1993 [DE] Germany ..... 43 12 720.7

[51] Int. Cl.[6] ..... F02M 33/02

[52] U.S. Cl. ..... 123/520; 123/516

[58] Field of Search ..... 123/520, 518, 123/519, 516, 521, 198 D

[56] References Cited

U.S. PATENT DOCUMENTS

| | | | |
|---|---|---|---|
| 4,070,828 | 1/1978 | Barres | 123/520 |
| 5,005,550 | 4/1991 | Bugin | 123/520 |
| 5,123,459 | 6/1992 | Toshihiro | 123/520 |
| 5,146,902 | 9/1992 | Cook | 123/518 |
| 5,183,023 | 2/1993 | Hanson | 123/520 |
| 5,245,975 | 9/1993 | Ito | 123/520 |
| 5,297,529 | 3/1994 | Cook | 123/520 |
| 5,333,589 | 8/1994 | Otsuka | 123/198 D |
| 5,347,971 | 9/1994 | Kobayashi | 123/198 D |
| 5,353,771 | 10/1994 | Blumenstock | 123/198 D |

FOREIGN PATENT DOCUMENTS

| | | | |
|---|---|---|---|
| 0408050 | 1/1991 | European Pat. Off. | 123/520 |
| 0000563 | 1/1984 | Japan | 123/520 |
| 0226553 | 10/1986 | Japan | 123/520 |

*Primary Examiner*—Carl S. Miller
*Attorney, Agent, or Firm*—Walter Ottesen

[57] ABSTRACT

The invention relates to a tank-venting apparatus for a motor vehicle as well as a method for operating the apparatus. The tank-venting apparatus is for a motor vehicle having an internal combustion engine equipped with a charger having an output line. The tank-venting apparatus includes: a tank; an adsorption filter having a venting line extending therefrom; a tank supply line connecting the tank to the adsorption filter; a tank-venting valve connected to the engine; a valve line connecting the tank-venting valve to the adsorption filter; and, control valve means for connecting the output line of the charger to the venting line. In contrast to conventional tank venting apparatus on motor vehicles having an internal combustion engine equipped with a charger, no pump is required which pumps the vapor from the tank-venting apparatus into the intake pipe against the overpressure.

9 Claims, 5 Drawing Sheets

TANK-VENTING APPARATUS FOR A MOTOR VEHICLE AND METHOD FOR OPERATING THE APPARATUS

FIELD OF THE INVENTION

The invention relates to a tank-venting apparatus for a motor vehicle having an internal combustion engine equipped with a charger and to a method for operating the tank-venting apparatus. The invention is also directed to a method for scavenging the adsorption filter of the tank-venting apparatus and for checking the operability of the apparatus.

BACKGROUND OF THE INVENTION

A tank-venting apparatus typically includes the following features: a tank, a tank-venting valve and an adsorption filter. The adsorption filter is connected to the tank via a supply line, has a connecting line for connecting the adsorption filter to the tank-venting valve and has a venting line.

An underpressure is generated in the valve line in order to vent the tank and to scavenge the adsorption filter with fresh air. The apparatus is used for an internal combustion engine without a charger in that the tank-venting valve is opened with the tank-venting valve being connected into the valve line connected to the intake pipe of the engine. For such an engine, except for full load, an underpressure is always present in the intake pipe which is adequate for venting the apparatus. In contrast, an overpressure is present in the intake pipe in an internal combustion engine equipped with a charger. For this reason, tank-venting apparatus which are to be operated on such an engine are provided with a pump in the valve line. This pump pumps vapor from the apparatus into the intake pipe. These conventional apparatus, however, have the disadvantage that they are relatively expensive because of the required pump.

SUMMARY OF THE INVENTION

It is an object of the invention to provide a tank-venting apparatus for a motor vehicle having an internal combustion engine equipped with a charger with the tank-venting apparatus being assembled in a simple manner. It is a further object of the invention to provide a method for scavenging the absorption filter of the tank-venting apparatus of the invention as well as a method for checking the operability of the apparatus.

The tank-venting apparatus of the invention is for a motor vehicle having an internal combustion engine equipped with a charger having a charging output line. The tank-venting apparatus includes: a tank; an adsorption filter having a venting line extending therefrom; a tank supply line connecting the tank to the adsorption filter; a tank-venting valve connected to the engine; a valve line connecting the tank-venting valve to the adsorption filter; and, control valve means for connecting the charging output line to the venting line.

The tank-venting apparatus according to the invention is characterized in that the venting line of the adsorption filter is connected to the output line of the charger via a pressure control device. In the simplest case, the pressure control device can be a pressure control valve for adjusting a pregiven maximum pressure at the output end of the valve connected to the venting line. However, a more flexible operation is possible when the pressure control valve device is a directional valve with the aid of which the venting line is either connected to the charger or to the ambient. The tank can be protected against an overpressure which is too large when the venting line is connected to the charger by either providing a tank check valve in the tank supply line which is closed in the case where pressure is applied or, the pressure control valve device can include a pressure control valve in addition to the directional valve. The pressure control valve limits the pressure from the charger to a value which does not damage the tank.

According to the method of the invention for scavenging the adsorption filter of the apparatus of the invention, the venting line of the adsorption filter is supplied with pressurized air from the charger during charging operation. In this way, a high scavenging rate is possible especially because the air at the output end of the charger is heated whereby the desorption of fuel vapors from the material of the adsorption filter is facilitated.

The operability of the tank-venting apparatus of the invention can be checked in that the apparatus is subjected to overpressure with the aid of the pressurized air from the charger. A conclusion is drawn as to the operability of the apparatus from the build-up gradient and/or the decay gradient of the overpressure in the tank. This can be carried out with a method for a function diagnosis as described in U.S. patent application Ser. No. 08/030,314, filed on Mar. 24, 1993, incorporated herein by reference, or, in that diagnostic methods can be correspondingly applied which operate with the build-up gradient and/or the decay of underpressure in lieu of overpressure. In this connection, reference may be made to U.S. patent application Ser. No. 08/129,039, filed Oct. 4, 1993, which discloses methods which are exemplary and which is also incorporated by reference.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
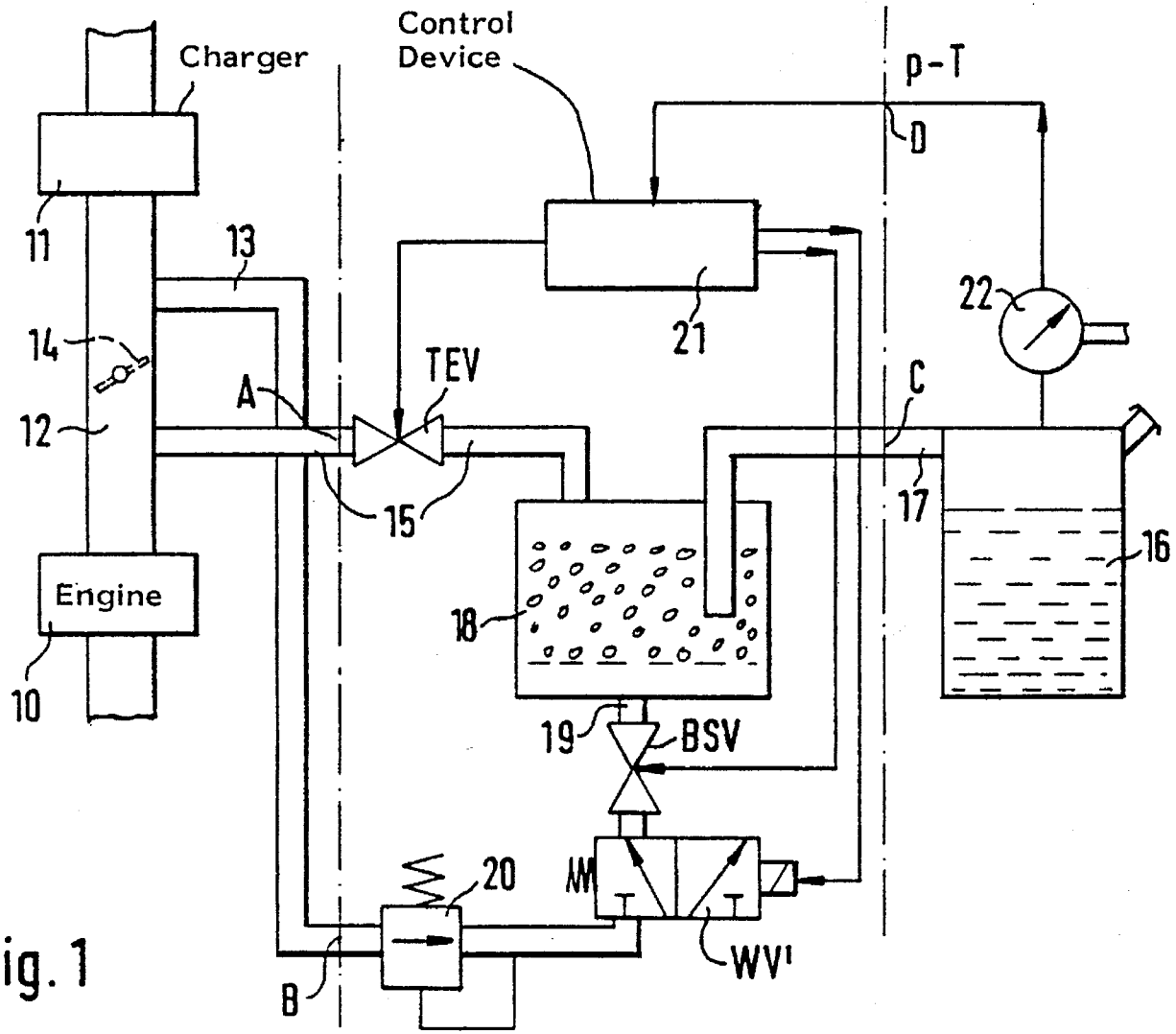
FIG. 1 is a block diagram of a tank-venting apparatus equipped with a pressure control valve arranged between the output line of a charger and the venting line of an adsorption filter as well as an electric switchover directional valve and an electrically driveable check valve in the venting line.

The tank-venting apparatus shown in FIG. 1 is operated on an internal combustion engine 10 having a charger 11. An output line of the charger or charging line 13 opens into the intake pipe 12 between the engine and the charger. The charging line 13 opens upstream of a throttle flap 14 provided in the intake pipe and a valve line 15 opens into the intake pipe downstream of the throttle flap. The charging line 13 and the valve line 15 pass through a broken auxiliary line in the diagram of FIG. 1 at positions A and B, respectively. The tank-venting apparatus is located to the right of this line. The tank-venting apparatus includes other parts which are explained in detail below as well as a tank 16 arranged to the right of a second broken line. A tank-connecting line 17 passes through the second broken line at location C. The assembly described up until now is the same in each of the embodiments of FIGS. 1, 3 and 4. For this reason, the following description is directed to those components of the tank-venting apparatus located between locations A, B and C.

An adsorption filter 18 defines the core of the tank-venting apparatus and is connected to the intake pipe 12 via the above-mentioned valve line 15. An electrically driveable venting valve TEV is mounted in the valve line 15. The adsorption filter 18 is connected to the tank 16 via the tank supply line 17. The adsorption filter 18 has a venting line 19 at its lower end which is connected to the charging line 13 via a pressure control valve 20, an electrically switchable directional valve WV' and an electrically driveable venting check valve BSV. These valves and the tank-venting valve TEV are driven by signals from a control device 21. The control device receives a difference pressure signal p_T from a tank-difference pressure sensor 22 mounted on the tank 16. The line conducting this signal passes through the second broken line at a location D.

The apparatus of FIG. 1 operates as follows in time intervals in which no functional check is made.

The control device 21 drives the tank-venting valve TEV at a pulse-duty factor in a manner known per se always then when tank venting is performed. The pulse-duty factor is determined in dependence upon the particular operating conditions. When the charger does not operate here, the directional valve WV' is not driven so that the directional valve is in its rest position shown in FIG. 1. In this rest position, the venting line 19 is connected to the ambient air. In this way, the apparatus is operated as a conventional tank-venting apparatus on an engine without a charger; that is, as an apparatus wherein the venting line 19 opens directly to the ambient. If required, the venting line 19 can be provided with a venting check valve BSV.

If in contrast, the charger 11 is operating, then the directional valve WV' is switched over whereby the valve now connects the venting line 19 to the charging line 13. The pressure in the charging line 13 as well as the pressure in the valve line 15 are greater than ambient pressure. The pressure in the charging line, as a rule, is higher than the pressure in the valve line even when the pressure in the charging line is limited by the pressure control valve 20. As long as a pressure difference of this kind is present, the adsorption filter is scavenged with air from the charging line because of the switched directional valve WV'. The pressure control valve 20 limits the pressure in the apparatus to a pregiven maximum value of, for example, 30 hPa.

The venting check valve BSV and the tank-difference pressure sensor 22 are not necessary in the simplest variation of the tank-venting apparatus according to the invention wherein the venting takes place as just described above. These parts are, however, then necessary when an especially effective method for checking the operability of the tank-venting apparatus is intended to be carried out. One example of such a method will now be described with respect to FIG. 2.

Figure 2:
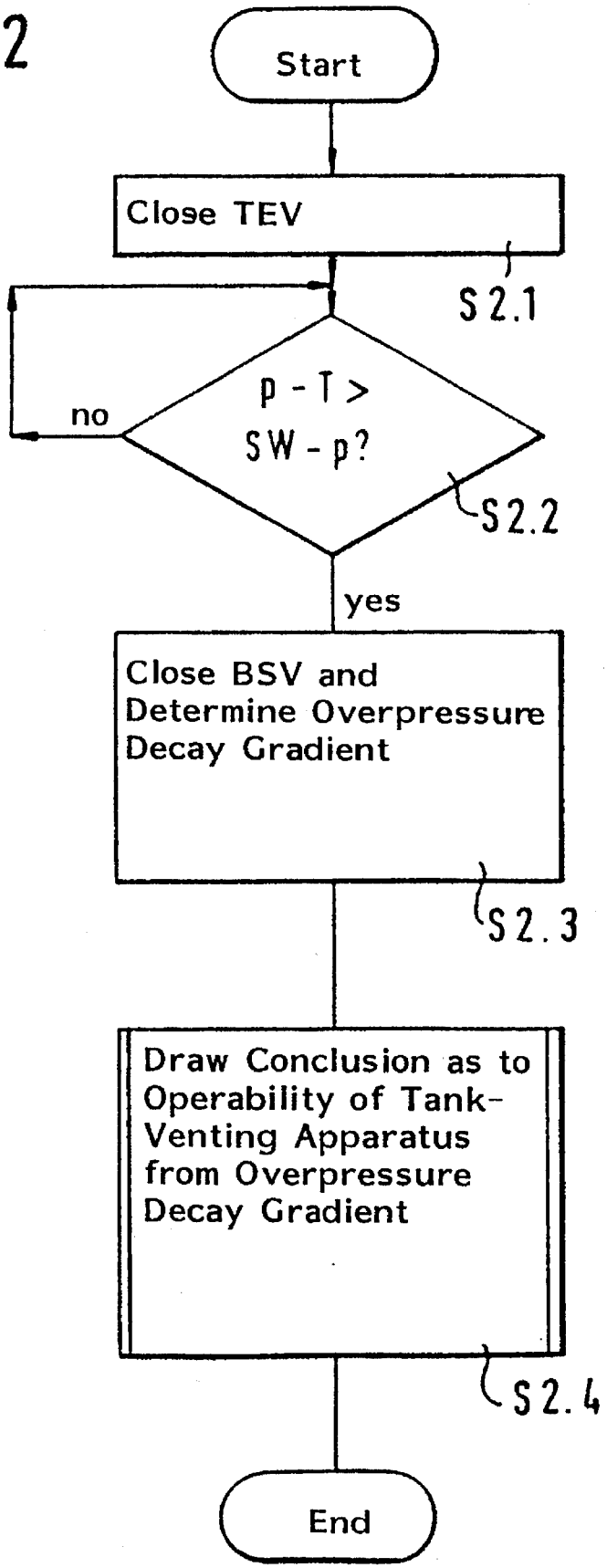
FIG. 2 is a flowchart for explaining the method of the invention for checking the operability of the tank-venting apparatus of FIG. 1.

The diagnostic method according to FIG. 2 takes place during charger operation. After the start of the method, the tank-venting valve TEV is closed by a corresponding signal from the control device in step S2.1. In step S2.2, the program waits until the tank-difference pressure p_T exceeds a threshold value SW_p. As soon as the control device 21 determines that this condition is satisfied, the control device drives the venting check valve BSV to close in step S2.3 and thereupon determines the decay gradient for the difference overpressure in the tank 16. In the next step S2.4, a conclusion as to the operability of the tank-venting apparatus is made with the aid of the determined overpressure decay gradient. This takes place with any one of the methods which were initially referred to herein.

Figure 4:
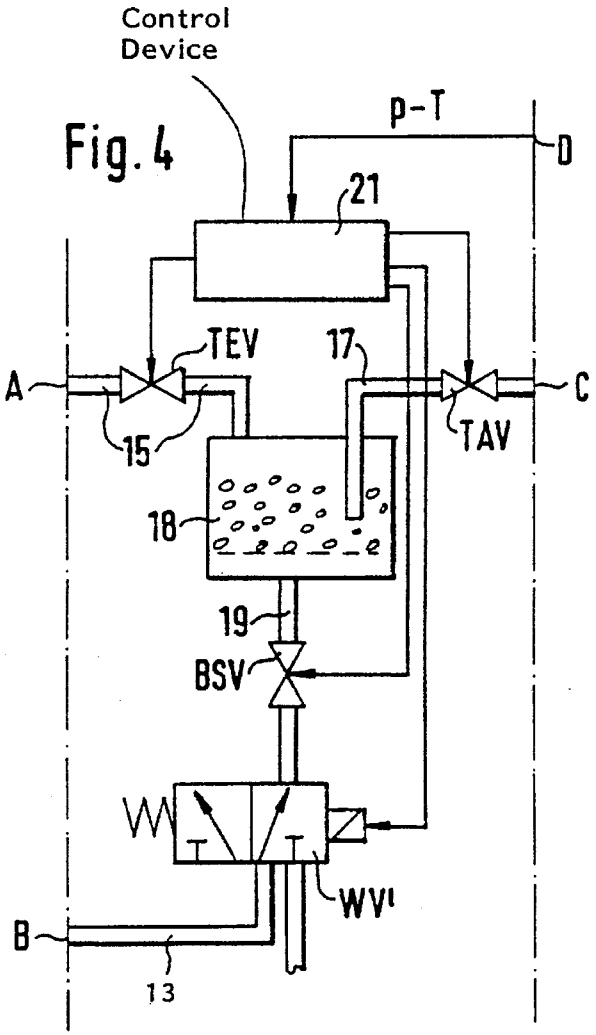
FIG. 4 is a component diagram of a tank-venting apparatus having an electrically driveable directional valve arranged between the output line of the charger and the venting line of an adsorption filter as well as a check valve in the venting line and a check valve in the tank supply line.
Figure 3:
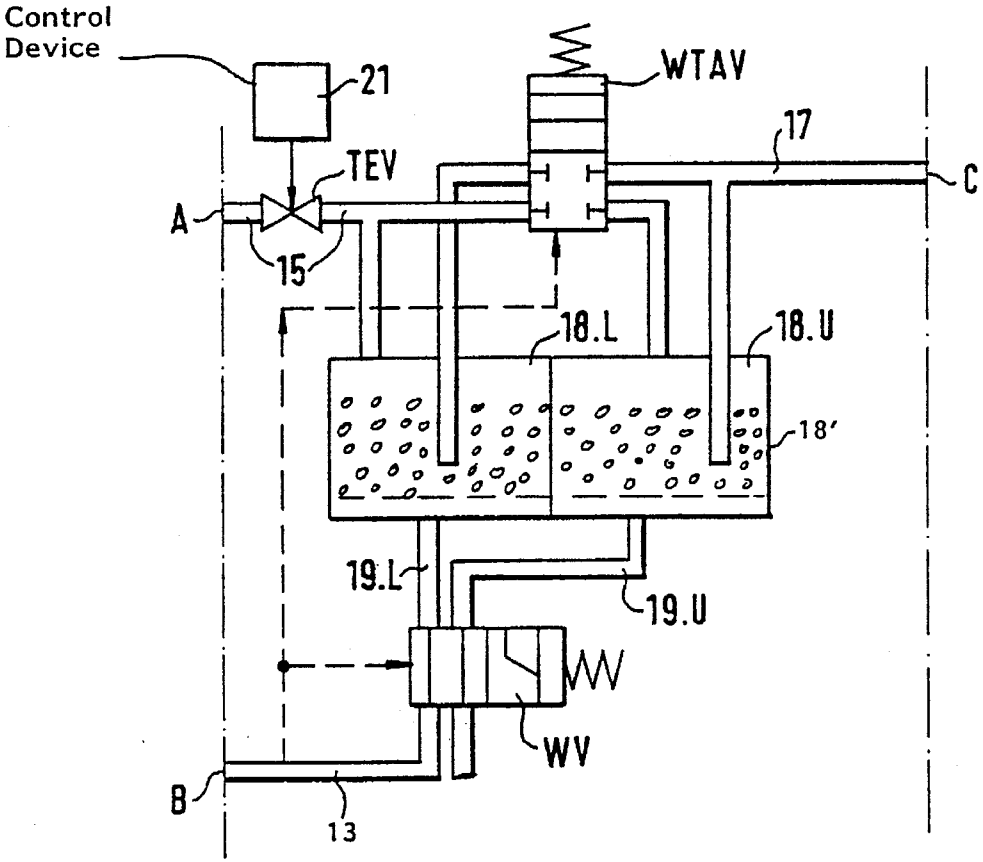
FIG. 3 is a component block diagram of a tank-venting apparatus having a pneumatically driven directional valve arranged between the output line of the charger and the venting line of an adsorption filter having two chambers.

In addition, it was explained above that the configuration of FIG. 1 can only then be used when the pressure in the intake pipe 12 at the connection location of the valve line 15 can never become greater than the output pressure of the pressure control valve 20. Otherwise, the maximum pressure in the tank 16, which is pregiven by the pressure control valve 20, would be exceeded. If it is intended to operate the apparatus on an engine wherein the pressure in the intake pipe at the connection location of the valve line can become greater than the maximum permissible pressure for the tank, a controllable check valve is inserted in the tank connecting line 17. FIG. 3 is directed to an embodiment wherein such a tank check valve is present in the form of a pneumatically controllable two-directional tank check valve WTAV; whereas, FIG. 4 is directed to an embodiment having an electrically driveable tank check valve TAV.

The embodiment of FIG. 3 includes the above-mentioned two-directional check valve WTAV, an adsorption filter 18' and a directional valve WV. The adsorption filter 18' has two chambers 18.U and 18.L mutually separated from each other with respect to pressure. The chambers 18.U and 18.L have respective venting lines 19.U and 19.L. The directional valve WV is located between the charging line 13 and the venting line unit 19.U/19.L. The chamber 18.U is always at ambient pressure; whereas, the chamber 18.L can be selectively at ambient pressure or at charging pressure. This condition is present because of the configuration of the directional valve WV which is in the position shown in FIG. 3 when the charging pressure is present in the charging line 13. In the position of the directional valve WV shown in FIG. 3, the venting line 19.L is connected to the charging line 13, the venting line 19.U is, however, connected to the ambient; whereas, when ambient pressure or even a slight underpressure is present in the charging line 13, the directional valve WV is in the position displaced to the left wherein both venting lines 19.L and 19.U are connected to the ambient.

The ambient pressure chamber 18.U of the adsorption filter 18' is continuously connected to the tank supply line 17; however, the ambient pressure chamber 18.U is connected to the valve line 15 via the two-directional tank-venting valve WTAV which can be blocked. Conversely, the charger pressure chamber 18.L is connected continuously to the valve line 15 and can be disconnected from the tank supply line 17 via the two-directional tank check valve. The position shown in FIG. 3 is present when there is charging pressure in the charging line 13. In this position, the two disconnections just mentioned are present. Together with the above-mentioned position of the directional valve WV in the venting line unit, this means that the tank 16 is actually vented via the ambient pressure chamber 18.U; whereas, the charging pressure chamber 18.L is regenerated at the same time. The tank 16 is then disconnected from the overpressure end.

If the pressure in the charge line 13 drops to ambient pressure, then the two valves WV and WTAV become displaced in the respective other positions not shown in FIG. 3 so that the two chambers 18.U and 18.L are connected to the ambient at the venting end and, at the same time, both chambers are connected to the tank supply line 17 and the valve line 15. The tank is then vented via both chambers and the adsorption filter in both chambers is regenerated.

With respect to the above-described embodiment, it is advantageous that the tank 16 is continuously vented and that regeneration is provided continuously, however, with only one of the two chambers of the adsorption filter 18 during charger operation. However, the complicated configuration of the adsorption filter and the requirement of two directional valves are disadvantageous. These disadvantages are avoided in the embodiment of FIG. 4.

In the embodiment of FIG. 4, an absorption filter 18 having the usual configuration is present as described with respect to FIG. 1. The pneumatically driven directional valve WV in the venting line device of the configuration of FIG. 3 is replaced by an electrically driveable directional valve WV' and, in lieu of the two-directional tank check valve WTAV, a simple electrically driveable tank check valve TAV is present. A venting check valve BSV is provided in the venting line 19 in correspondence to the configuration of FIG. 1. A tank-difference pressure sensor 22 is provided on the tank 16 as in the embodiment of FIG. 1 (not shown in FIG. 4). However, the signals of the tank-difference pressure sensor 22 are now not only used to diagnose the tank, but also to control the regeneration of the adsorption material in the adsorption filter 18.

In FIG. 4, the directional valve WV' is in its energized position. This is basically then the case, when the control device 21 receives an announcement from the charger 11 that the charger is operating. The venting check valve BSV is then opened whereas the tank check valve 21 is driven so as to close. When the tank-venting valve TEV is now driven in a clocked manner, the material in the adsorption filter 18 is regenerated by the air flow which flows from the output line of the charger 11 through the directional valve WV', the venting check valve BSV, the adsorption filter 18, the valve line 15 and the tank-venting valve TEV to the low-pressure side of the intake pipe 12.

If the charger 11 discontinues its operation because the engine rpm is too low, then the control device 21 switches the directional valve WV' into its rest position in response to this data and opens the tank check valve TAV. The tank is now vented. Regeneration takes place with the aid of the underpressure in the intake pipe 12 with the ambient air flowing through the switched directional valve WV' into the adsorption filter 18.

The tank is not vented as long as the tank check valve TAV is closed. If the fuel now vaporizes in the tank, this leads to an increase of the difference pressure of the tank with respect to the ambient. This difference pressure p_T is announced by the difference pressure sensor 22 to the control device 21. As soon as the difference pressure exceeds a threshold value of, for example, 30 hPa, the control device 21 closes the tank-venting valve TEV, switches the directional valve WV' into its rest position and opens the tank check valve TAV. In this way, the tank is vented to the active charcoal filter 18. If an operating phase of the engine without charger operation begins, then the tank-venting valve can again be driven open in order to undertake a regeneration of the adsorption filter 18. Otherwise, as soon as the difference overpressure in the tank has dropped below a pregiven threshold, such as 5 hPa, a switchover occurs to the condition of the regeneration with compressed air as first described.

Figure 5:
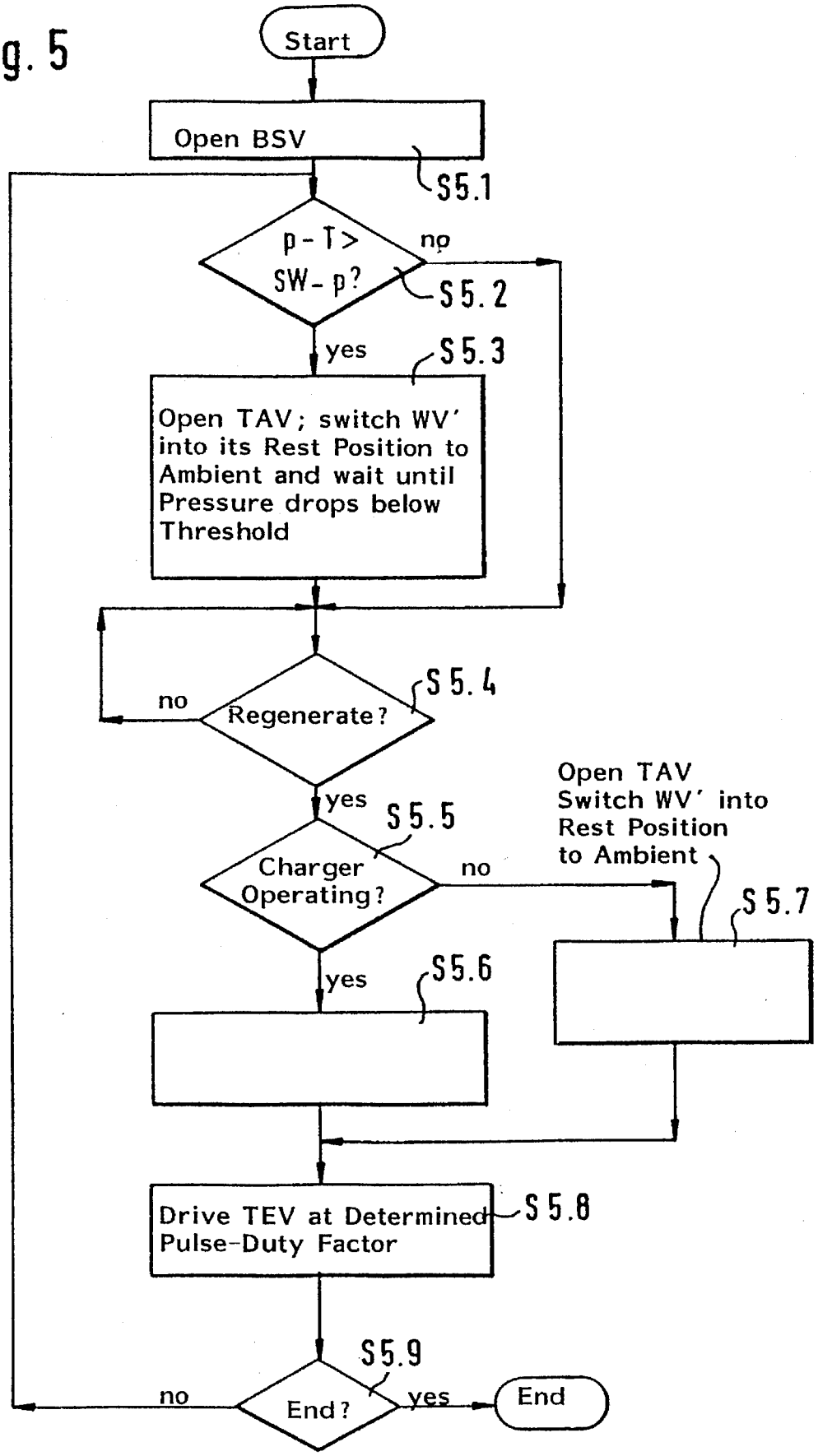
FIG. 5 is a flowchart for explaining the method for scavenging the adsorption filter in the tank-venting apparatus of FIG. 4; and, FIG. 6 is a flowchart for explaining a method for checking the operability of the tank-venting apparatus of FIG. 4.

An embodiment of a sequence of regeneration or scavenging of the adsorption filter 18 in the tank-venting apparatus of FIG. 4 will now be described with respect to the flowchart of FIG. 5. After the start of the method, a determination is made in step S5.1 that the venting check valve BSV is open since this valve should only be closed for tank diagnostic purposes. In step S5.2, a check is made as to whether the tank difference pressure p_T is greater than the threshold valve SW_p. If this is the case then, as described, the tank-venting valve TAV is opened and the directional valve WV' is switched over to its rest position in which it connects the venting line to the ambient. The program then waits until the overpressure in the tank has dropped below the above-mentioned threshold (step S5.3). Thereafter, in step S5.4, an inquiry is made as to whether regeneration should take place. This step is reached directly when the inquiry in step S5.2 is answered in the negative. As soon as it is determined in step S5.4 that regeneration should take place (which for normal operation takes place at the very latest after several minutes have passed), an inquiry is made in step S5.5 as to whether charger operation takes place. If this is the case, then the tank-venting valve TAV is closed and the directional valve WV' is switched over so that this valve connects the venting line 19 to the charging line 13 (step S5.6). If no charger operation is present, the tank check valve TAV is opened in step S5.7 and the directional valve WV' is switched over into its rest position in the event that this has not already taken place in step S5.3. A step S5.8 is reached after step S5.6 as well as after step S5.7. In step S5.8, the tank-venting valve TEV is driven by the control device 21 at the pregiven pulse-duty factor for carrying out the regenerating procedure. Thereafter, an inquiry is made (step S5.9) as to whether the method should be ended, for example, when the engine is brought to standstill. If this is the case, then the end of the method is reached; otherwise, the sequences starting with step S5.2 are repeated.

Figure 6:
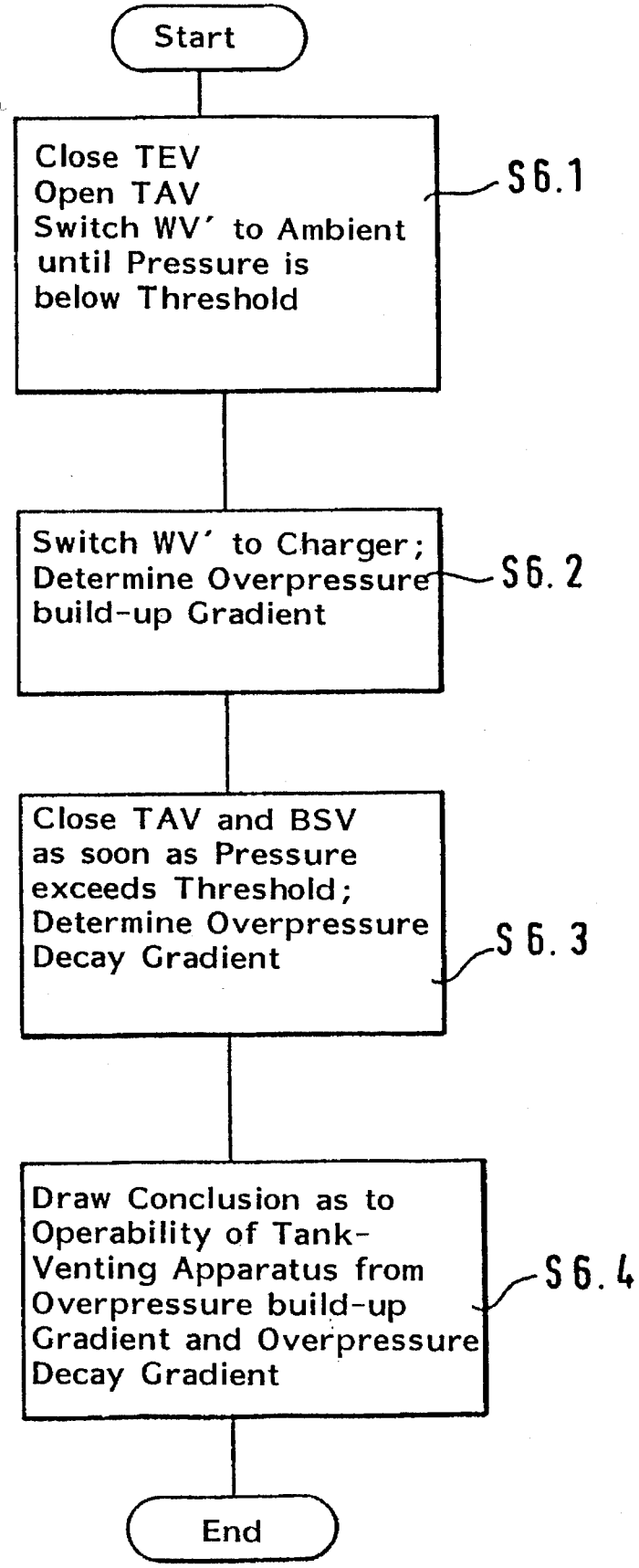

FIG. 6 shows an embodiment for a method for checking the operability of the tank-venting apparatus of FIG. 4. This method is only carried out during charger operation. As soon as charger operation is present and the method is started, the tank-venting valve is closed in step S6.1. The tank check valve TAV is opened and the directional valve WV' is shifted into its rest position. This takes place so that ambient pressure adjusts in the tank. Thereafter, in step S6.2, the directional valve WV' is switched over so that pressurized air is pumped into the tank-venting apparatus via the charging line 13. During this operation, the gradient of the overpressure build-up in the tank is determined. Thereupon, in step S6.3, the tank check valve TAV is closed as soon as it is determined that a pregiven difference overpressure p_T has been reached in the tank. The pressure decay gradient is determined in the tank starting with the closure time point of the tank check valve. The values for the overpressure build-up gradient and the underpressure decay gradient are determined in steps S6.2 and S6.3, respectively. From these values, a conclusion is drawn in a subprogram step S6.4 as to the operability of the tank-venting apparatus. This takes place in accordance with one of the methods mentioned initially. The basic principle of all these methods is that the pressure build-up gradient (be it an underpressure build-up gradient or an overpressure build-up gradient) must show a relatively high value when the apparatus is intact while the pressure decay gradient (be it underpressure decay gradient or overpressure decay gradient) can only have a relatively low value. Especially reliable statements are obtained when, as for the sequence of FIG. 6, both types of gradients are detected and evaluated especially when the quotient of both gradients is compared to a threshold value.

The directional valves of FIG. 3 can be driven electrically in lieu of pneumatically. The switchover is then triggered by a signal from the charger 11 to the control device 21 in lieu of by the charger pressure.

When a tank check valve TAV is present, as in the assembly of FIG. 4, it is possible to detect whether the basis for a malfunction of the tank-venting apparatus is present at the section between the tank-venting valve TEV and the tank check valve TAV or between the tank check valve TAV and the tank closure. If a leak is determined within the entire apparatus, for example, by a function check with the aid of the overpressure build-up gradient and/or the overpressure decay gradient then, for a second check passthrough, the overpressure in the tank can be built up again and the overpressure decay gradient is detected and compared to a threshold value after the closure of the tank check valve TAV. If the overpressure decays faster than in correspondence to the gradient threshold value, this shows that a leak must be present in the region between the tank check valve and the tank closure. Otherwise, the leak must be in the region between the tank-venting valve TEV and the tank check valve TAV.

A diagnosis of the operability of the tank-venting apparatus at overpressure in lieu of at underpressure affords the following advantages:

(a) in the overpressure region, the tank can withstand more than in the underpressure region, namely, typically approximately 200 hPa in lieu of only approximately −30 hPa;

(b) as long as vapor is drawn off by suction with underpressure for the diagnosis, fuel vapor from the adsorption filter occurs or occurs directly from the tank. If the tank-venting valve is closed when the underpressure is reached, then a break in the rpm results because of the sudden absence of the tank vapor quantity;

(c) in an underpressure check, vaporizing fuel, especially during diagnosis can convey the impression of a leak with the aid of an underpressure decay gradient when the underpressure decays rapidly because of intensely vaporizing fuel whereby the presence of a leak is indicated which is really not there; and, (d) for an underpressure check, the vaporization of fuel is facilitated because of the underpressure which is not the case for an overpressure check.

It is understood that the foregoing description is that of the preferred embodiments of the invention and that various changes and modifications may be made thereto without departing from the spirit and scope of the invention as defined in the appended claims.

What is claimed is:

1. A tank-venting apparatus for a motor vehicle having an internal combustion engine equipped with a charger having a charger output line, the tank-venting apparatus comprising:

a tank, an absorption filter having a venting line extending therefrom;

a tank supply line connecting said tank to said adsorption filter;

a tank-venting valve connected to the engine;

a valve line connecting said tank-venting valve to said adsorption filter;

control valve means for connecting said charger output line to said venting line; and, said control valve means including a directional valve switchable between a first position wherein said venting line is connected to said charger output line and a second position wherein said venting line is connected to the ambient.

2. A tank-venting apparatus for a motor vehicle having an internal combustion engine equipped with a charger having a charger output line, the tank-venting apparatus comprising:

a tank;

an adsorption filter having a venting line extending therefrom;

a tank supply line connecting said tank to said adsorption filter;

a tank-venting valve connected to the engine;

a valve line connecting said tank-venting valve to said adsorption filter;

control valve means for connecting said charger output line to said venting line;

said control valve means including a directional valve switchable between a first position wherein said venting line is connected to said charger output line and a second position wherein said venting line is connected to the ambient; and, said control valve means further including a pressure control valve having an input end and an output end and being mounted in said charger output line with said output end connected to said directional valve; and, said pressure control valve being configured to adjust the pressure at said output end to a predetermined maximum pressure.

3. The tank-venting apparatus of claim 1, further comprising a tank check valve connected into said tank supply line.

4. The tank-venting apparatus of claim 1, further comprising venting line means including said venting line and a venting check valve connected into said venting line.

5. A tank-venting apparatus for a motor vehicle having an internal combustion engine equipped with a charger having a charger output line, the tank-venting apparatus comprising:

a tank;

an adsorption filter having a venting line extending therefrom;

a tank supply line connecting said tank to said adsorption filter;

a tank-venting valve connected to the engine;

a valve line connecting said tank-venting valve to said adsorption filter;

control valve means for connecting said charger output line to said venting line;

said control valve means including a directional valve switchable between a first position wherein said venting line is connected to said charger output line and a second position wherein said venting line is connected to the ambient; and, a control device operatively connected to said charger for receiving a signal therefrom indicating when said charger is operating; and, said control device being configured to switch said directional value into said first position when said adsorption filter is to be regenerated with air from said charger.

6. A method for operating a tank-venting apparatus which includes a tank, a charger, an adsorption filter having a venting line extending therefrom; a tank supply line connecting said tank to said adsorption filter; a tank-venting valve connected to the engine; a valve line connecting as a tank-venting valve to said adsorption filter; and, control value means for connecting a charger output line to said venting line, said control valve means including a directional valve switchable between a first position wherein said venting line is connected to said charger output line and a second position wherein said venting line is connected to the ambient, the method comprising the step of switching said directional valve between said first position wherein said venting line is connected to said charger output line so as to pass air under pressure to said venting line for scavenging said adsorption filter when said charger is in operation and said second position wherein said venting line opens to the ambient.

7. The method of claim 6, wherein said apparatus includes a tank check valve in said tank supply line; and, wherein the method further comprises the step of keeping said tank check valve closed as long as said venting line is supplied with compressed air from said charger.

8. The method of claim 7, wherein the method includes checking the operability of said apparatus during operation of said charger, the method further comprising the steps of:

closing said tank-venting valve, opening said tank check valve and subjecting said apparatus to overpressure by supplying air from said charger to said venting line via said control valve means;

measuring the gradient of the overpressure building up in said tank; and, drawing a conclusion as to the operability of said apparatus with the aid of the overpressure build-up gradient.

9. The method of claim 7, wherein said apparatus further includes venting line means including said venting line and a venting check valve connected into said venting line; and, wherein the method includes checking the operability of said apparatus during operation of said charger, the method further comprising the steps of:

closing said tank-venting valve, opening said tank check valve and subjecting the apparatus to overpressure by supplying air from said charger to said venting line;

closing said venting check valve;

measuring the gradient of the overpressure decaying in said tank; and, drawing a conclusion as to the operability of said apparatus with the aid of the overpressure decay gradient.

* * * * *

UNITED STATES PATENT AND TRADEMARK OFFICE

CERTIFICATE OF CORRECTION

PATENT NO. : 5,511,529

DATED : April 30, 1996

INVENTOR(S) : Andreas Blumenstock and Helmut Denz

It is certified that error appears in the above-identified patent and that said Letters Patent is hereby corrected as shown below:

In column 1, line 43: between "charger" and "with" (second occurrence), please insert -- , --.

In column 2, line 5: please delete "or," and substitute -- or -- therefor.

In column 2, lines 31 and 32: please delete "patent application serial no. 08/129,039, filed October 4, 1993," and substitute -- Patent 5,463,998 -- therefor.

In column 6, line 11: please delete "tank-venting" and substitute -- tank check -- therefor.

In column 6, line 24: please delete "tank-venting" and substitute -- tank check -- therefor.

UNITED STATES PATENT AND TRADEMARK OFFICE
CERTIFICATE OF CORRECTION

PATENT NO. : 5,511,529

DATED : April 30, 1996

INVENTOR(S) : Andreas Blumenstock and Helmut Denz

It is certified that error appears in the above-identified patent and that said Letters Patent is hereby corrected as shown below:

In column 7, line 41: between "diagnosis" and "can", please insert -- , --.

In column 7, line 60: please delete "absorption" and substitute -- adsorption -- therefor.

In column 9, line 5: please delete "as a" and substitute -- said -- therefor.

In column 9, line 7: please delete "value" and substitute -- valve -- therefor.

Signed and Sealed this

Second Day of September, 1997

*Attest:*

Bruce Lehman

BRUCE LEHMAN

*Attesting Officer*

*Commissioner of Patents and Trademarks*